US006846119B2

(12) United States Patent
Walling

(10) Patent No.: US 6,846,119 B2
(45) Date of Patent: Jan. 25, 2005

(54) METHOD AND HANDHELD DEVICE FOR PRINTING

(75) Inventor: Alex Walling, Solna (SE)

(73) Assignee: Print Dreams Europe AB, Kista (SE)

( * ) Notice: Subject to any disclaimer, the term of this patent is extended or adjusted under 35 U.S.C. 154(b) by 0 days.

(21) Appl. No.: 10/297,254

(22) PCT Filed: Jun. 8, 2001

(86) PCT No.: PCT/SE01/01307

§ 371 (c)(1),
(2), (4) Date: Apr. 7, 2003

(87) PCT Pub. No.: WO01/94118

PCT Pub. Date: Dec. 13, 2001

(65) Prior Publication Data

US 2004/0022571 A1 Feb. 5, 2004

(30) Foreign Application Priority Data

Jun. 9, 2000 (SE) ..... 0002175

(51) Int. Cl.[7] ..... B41J 3/36
(52) U.S. Cl. ..... 400/88; 347/109
(58) Field of Search ..... 101/486, 217, 101/407.1; 347/109, 188, 222, 215, 171; 358/296, 473, 443, 1.18; 400/88, 693; 346/143

(56) References Cited

U.S. PATENT DOCUMENTS 4,819,083 A * 4/1989 Kawai et al. ..... 358/451
4,851,896 A * 7/1989 Muranaga et al. ..... 358/443
4,868,676 A * 9/1989 Matsuura et al. ..... 358/296
4,915,027 A * 4/1990 Ishibashi et al. ..... 101/486
4,947,262 A * 8/1990 Yajima et al. ..... 358/296
5,024,541 A 6/1991 Tsukada et al. ..... 400/88
5,063,451 A * 11/1991 Yanagisawa et al. ..... 346/143
D336,917 S * 6/1993 Iwanaga ..... D18/52
5,308,173 A * 5/1994 Amano et al. ..... 400/29
D360,890 S * 8/1995 Tremlett ..... D18/19
5,446,559 A * 8/1995 Birk ..... 358/473
5,634,730 A * 6/1997 Bobry ..... 400/88
5,685,651 A * 11/1997 Hayman et al. ..... 400/88
5,816,718 A * 10/1998 Poole ..... 400/88
5,825,995 A * 10/1998 Wiklof et al. ..... 358/1.18
D406,160 S * 2/1999 Davis ..... D18/14
5,887,992 A * 3/1999 Yamanashi ..... 400/88
5,927,872 A * 7/1999 Yamada ..... 400/88
5,988,900 A * 11/1999 Bobry ..... 400/88
6,068,420 A * 5/2000 Austin et al. ..... 400/693
6,177,926 B1 * 1/2001 Kunert ..... 345/173
6,229,565 B1 * 5/2001 Bobry ..... 348/207.99
6,261,011 B1 * 7/2001 Day et al. ..... 400/88
6,268,598 B1 * 7/2001 Dow et al. ..... 250/208.1
6,292,274 B1 * 9/2001 Bohn ..... 358/473
6,312,124 B1 * 11/2001 Desormeaux ..... 347/109
6,476,928 B1 * 11/2002 Barbour et al. ..... 358/1.15
D467,962 S * 12/2002 Ishigami ..... D18/14
6,499,840 B2 * 12/2002 Day et al. ..... 347/100
6,543,893 B2 * 4/2003 Desormeaux ..... 347/109
6,550,683 B1 * 4/2003 Augustine ..... 235/462.45
6,609,844 B1 * 8/2003 Petteruti et al. ..... 400/88
6,618,068 B2 * 9/2003 Ishikawa ..... 347/215

FOREIGN PATENT DOCUMENTS

GB 2 343 656 A 5/2000

* cited by examiner

*Primary Examiner*—Andrew H. Hirshfeld
*Assistant Examiner*—Wasseem H. Hamdan
(74) *Attorney, Agent, or Firm*—Dickstein Shapiro Morin & Oshinsky, LLP

(57) ABSTRACT

A handheld printing device and method for printing are disclosed. The handheld device comprises a print head, a graphical screen and at least one positioning sensor that co-operates with a micro controller circuit. The print head can be moved by hand directly to the area where the text or image is to be printed, and can be automatically steered to enable a faster printout, especially for printouts having text or images spread out over the printout surface with empty space in between. The manual movement of the print head is facilitated by the graphical screen of the device showing at each moment a portion of the picture corresponding in position to the printout in progress.

8 Claims, 3 Drawing Sheets

METHOD AND HANDHELD DEVICE FOR PRINTING

FIELD OF THE INVENTION

The invention relates to a handheld device for printing and a method of printing with a handheld device.

BACKGROUND OF THE INVENTION

Conventional printers of today operate with automatic feed, where the print head moves over the printout surface in a predetermined pattern. This is a drawback, since the print head has to sweep over the entire printout surface even if it is to be active only in relatively small areas, such as for example, the lower right-hand corner of the printout.

A further drawback with conventional printers is their great size, which means that they are more or less stationary.

OBJECTS OF THE INVENTION

A main object of the invention is to provide a method and device for performing an accurate and high-quality printout with a handheld printing device with no mechanisms for automatic feed of a printing paper or automatic steering of a print head.

Another object of the invention is to enable a convenient start of the whole printout with great precision.

SUMMARY OF THE INVENTION

The invention relates to a method and device for printing, comprising a graphical screen through which a non-automatic printing process can be supervised, in particular a method where the user steers the entire device by hand over the printing surface. The automatic steering of a print head has thus been replaced by manual movements. This enables a faster printout, especially for printouts having text or images spread out over the printout surface with much empty space in between. The print head can be moved by hand directly to the area where the text or image is to be printed.

The manual movement is facilitated by the graphical screen on the device showing at each moment a portion of the picture corresponding in position to the printout in progress. This is accomplished by one or more positioning sensors co-operating with a micro controller circuit.

By designing a "virtual" window in the screen, where a dynamic picture corresponding to the actual printout is re-created, a feeling of seeing right through the screen and directly onto the printing paper is accomplished. In this way, the printout process can be supervised effectively in real-time.

The parts of the printout which have not yet been completed can preferably be re-created as contours that are filled in gradually as the print head passes the current areas.

In this way, the printing process is supervised in a more accurate and controlled way.

The other object of the invention, i.e. to enable a convenient start of the whole printout with great precision, is achieved by showing an easily recognisable part of the picture, e.g. the upper left-hand corner of the printout, on the screen. The device can then be positioned exactly where the printout is to be started. Then the printout may be started by means of a push button.

As a supplement to the "virtual" window on the screen, a group of 4–8 arrows may be shown beside it. These arrows are intended to guide the user where to lead the printing device for the printout to be accomplished faster.

Another supplementary graphic may be a status section that can show how much, expressed as a percentage, of the printout that is finished, and also what process is in progress at each moment.

The invention will now be explained further below, way of examples, with reference to the accompanying drawings.

BRIEF DESCRIPTION OF THE DRAWINGS

FIG. 6 shows, in a perspective view, a second embodiment of the printing device according to the

DETAILED DESCRIPTION OF PREFERRED EMBODIMENTS

Figure 1:
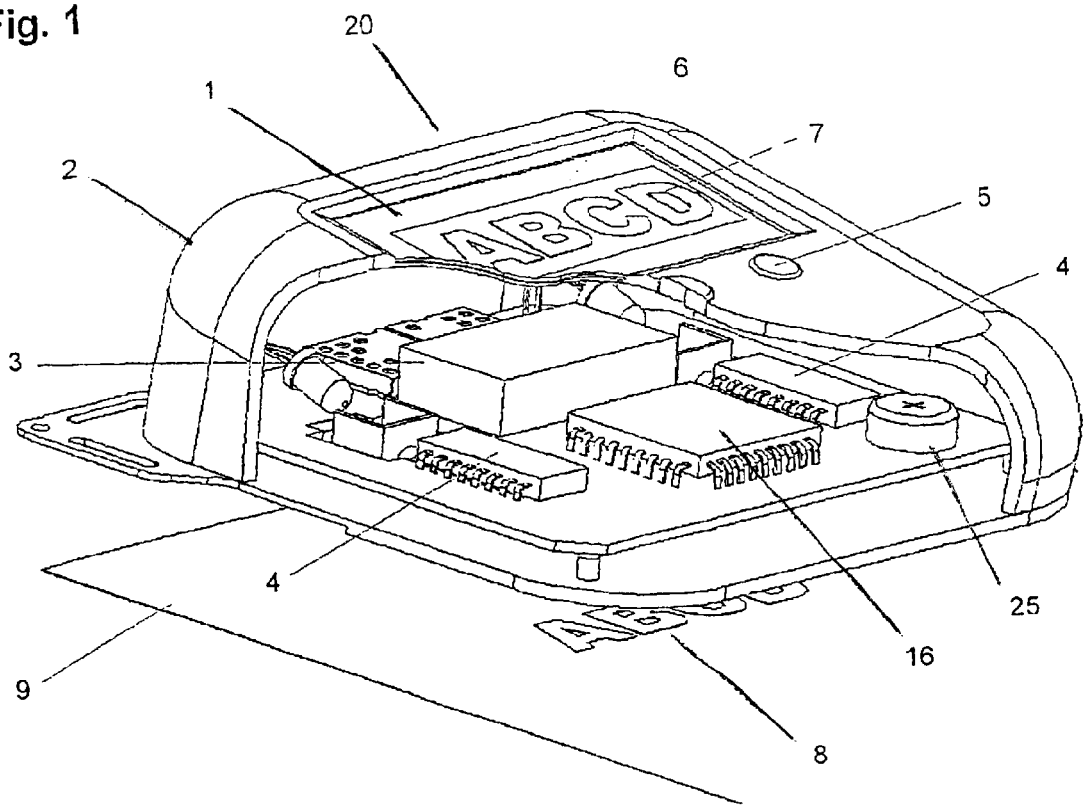
FIG. 1 shows a perspective view of the printing device with a screen according to the invention, a portion of the housing being cut away for clarity.

In FIG. 1, there is shown a screen 1 built into a handheld printing device 20 comprising a print head 3 co-operating with one or more positioning sensors 4, a micro controller circuit 16 and one or more command buttons 5. The print head may be an ordinary ink-jet printer, e.g. a piezo jet printer Model Xaar Jet128, available from XaarJet. Alternatively, a bubble jet print head could be used. The screen 1 is preferably an OLED (Organic Light Emitting Diods), available from for example RITEK Display Technology, but could be an ordinary LCD (Liquid Crystal Display) or a TFT (Thin Film Technology). OLEDs are preferred since they have fast response times.

The printing device according to the present invention also includes a housing 2 (preferably made of a plastic material, but could of course be of any other suitable material), mounted on a bottom plate 21. The bottom plate has openings for the print head 3 and one or more sensors 4. The bottom plate 21 is not of uniform thickness, but is divided into two parts. The part of the bottom plate 21 that includes the opening for the print head 3 is somewhat thinner than the rest of the plate, in order to create sufficient space for the print head 3 when it is printing. The other part of the bottom plate 21 is in contact with the printing surface 9. The printing device may be battery operated, in which case a battery 25 is included. Alternatively, the printing device 20 could be wire-lined or wireless fed, in which case outputs for this should be included (not shown).

In the embodiment in accordance with FIG. 1, the screen 1 includes a "virtual" window 6 where a dynamic image 7 of the printout in progress (a portion of the picture to be printed) is re-created. The image 7 corresponds to the picture in progress 8 on the printing surface 9 both as regards position and scale.

The positioning sensors 4 register in real-time where the printing device 20 and thus the print head 3 is located during the whole printing process. The sensors used could for example be HDNS-2000, available from Agilent Technologies. By means of data received from the positioning sensors, the micro controller circuit is then able to calculate exactly how the image 7 in the window 6 should look at each separate moment. The result will be such that the image 7 is perceived as totally fixed to the surface 9 even when the printing device 20 is moved around.

Figure 2:
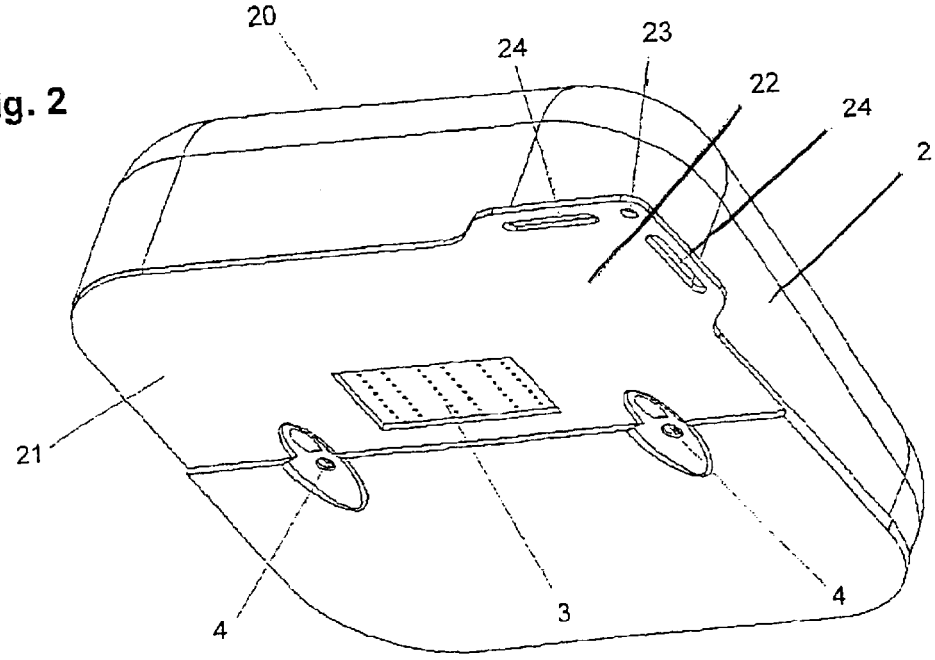
FIG. 2 shows a perspective view from underneath of the printing device comprising a screen according to the invention.

FIG. 2 shows the printing device 20 from underneath, illustrating particularly the print head 3 and the positioning sensors 4, there being two such sensors in the illustrated embodiment.

The bottom plate 21 may include a corner portion 22 projecting outwardly a bit, as shown in FIG. 2. In FIG. 2 this portion is shown having a hole 23 in its edge and two slits 24 along the sides. These are helpful in positioning the printout at the surface. When doing so, the hole 23 is placed so that, for example, the upper left-hand corner of the printing surface is visible through it, whereas the slits are placed along the sides of the surface. Thereby a more accurate positioning of the printout at the surface is accomplished.

Figure 3:
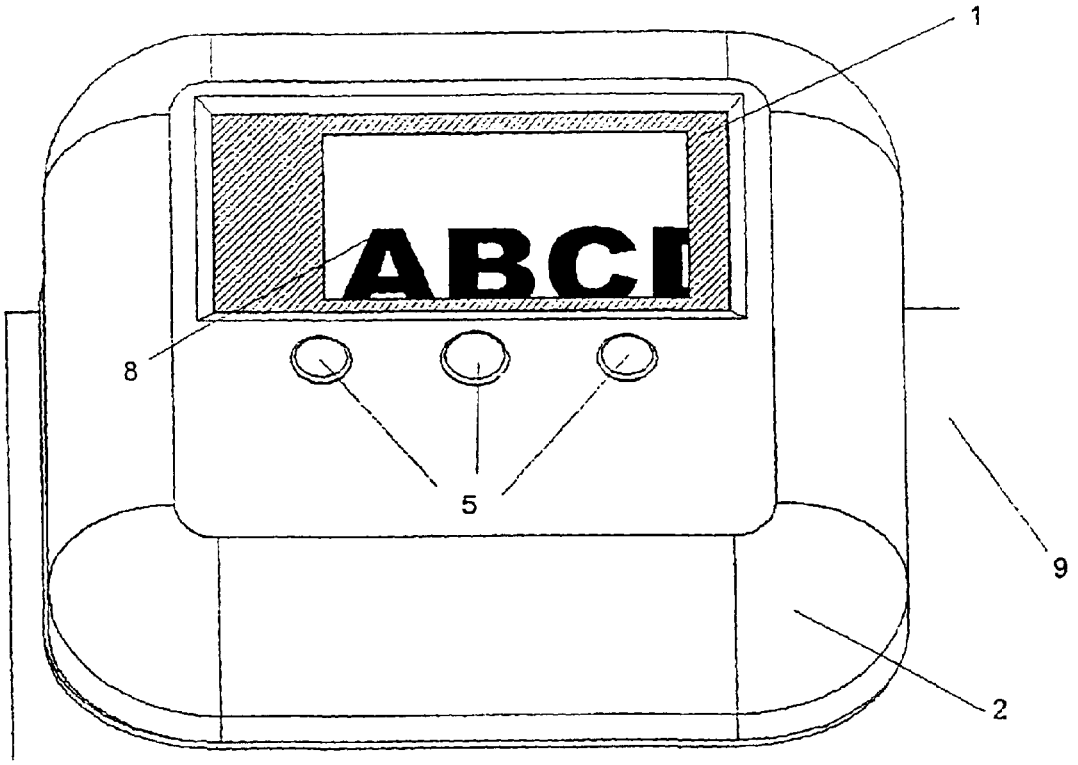
FIG. 3 shows, likewise in a perspective view, the front of the printing device of FIGS. 1 and 2.

In FIG. 3 the activated screen 1 is shown comprising a static preview of for example the upper left corner of the printout 7. The intent is that the user should be able to place the printing device 20 so that the particular corner is used as a reference point in order to more precisely position the printout 7 in advance at the surface 9. The printing process may thereafter begin with a push on one of the buttons 5.

Figure 4:
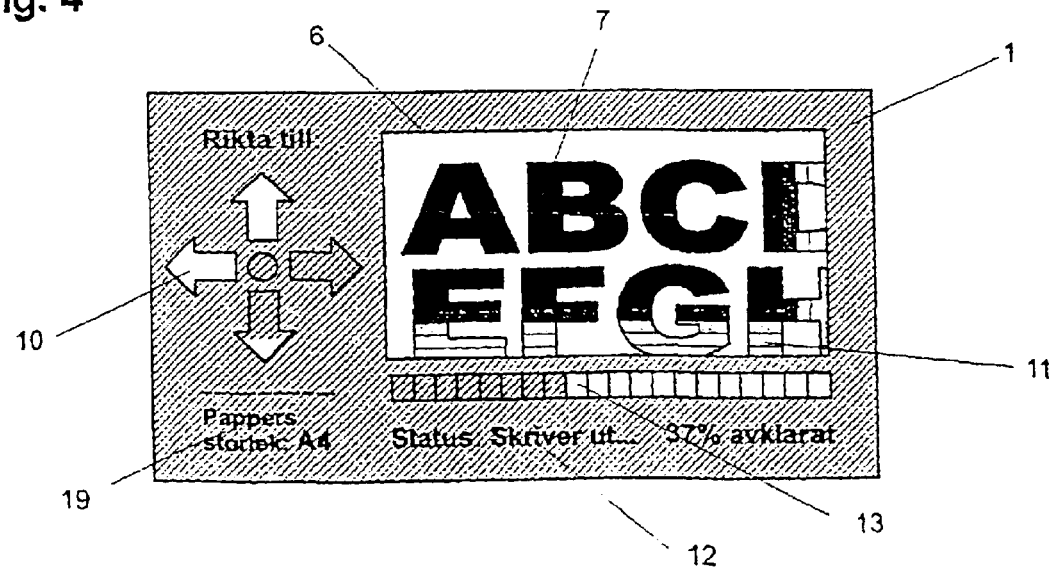
FIG. 4 shows, in a schematic view from the front, a modified embodiment of the screen of the device.

In the embodiment according to FIG. 4, the screen 1 has been supplemented with a set of graphical arrows 10 designed to guide the user to where the printing device 20 should be moved next. This is done in order to speed up and facilitate the printing process.

By means of a computer program, taking into consideration where the print head 3 has been active, it is possible to retrieve so called white spots on the printout 8, and then build up a recommendation in the form of blinking graphical arrows 10 showing the direction in which the user should move the print head 3.

The same algorithms may be used in order to initially show the image 7 in the window 6 only as simple, not filled-in contours 11, which are subsequently filled in gradually as the print head 3 passes over the particular areas on the printing surface 9.

The embodiment according to FIG. 4 also shows an optional status field 12 illustrating by means of figures and/or graphics 13, how much—expressed as a percentage—of the printout 8 that remains. This can be combined with a setting where one states at which percentage level the printout 8 is to be considered finished. Other relevant information, such as the size of paper 19 to be used for the printout or what process is in progress at each moment, may also be shown at the side.

Figure 5:
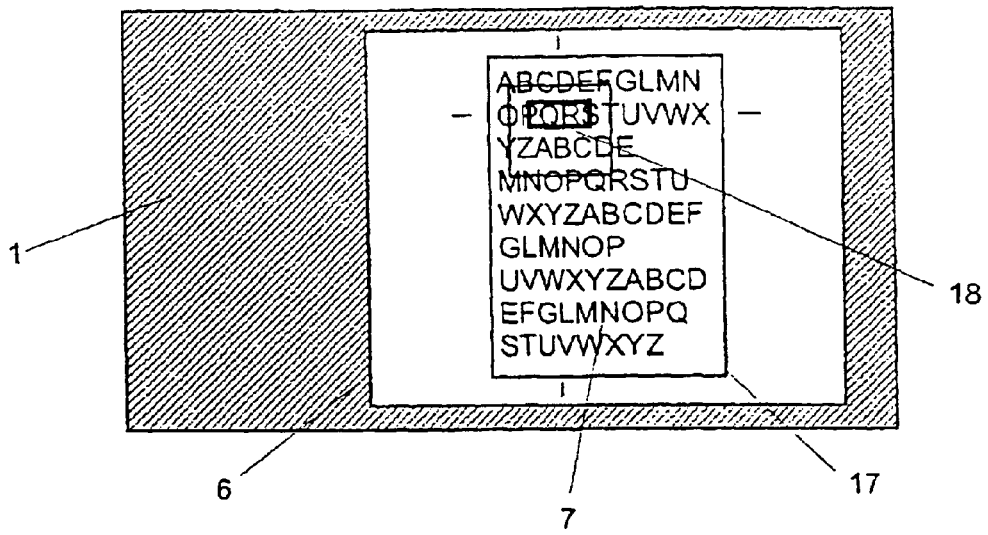
FIG. 5 shows, in a schematic view from the front, a further embodiment of the screen of the device.

The embodiment according to FIG. 5 shows how the image 7 may be configured in order to agree in position with the printout in progress 8, although it is shown in size as a whole printout page 17 in the window 6. The print head 3 is represented as a dynamic rectangle 18 moving over the printout page 17 as the user moves the printing device 20 over the printing surface 9.

Figure 6:
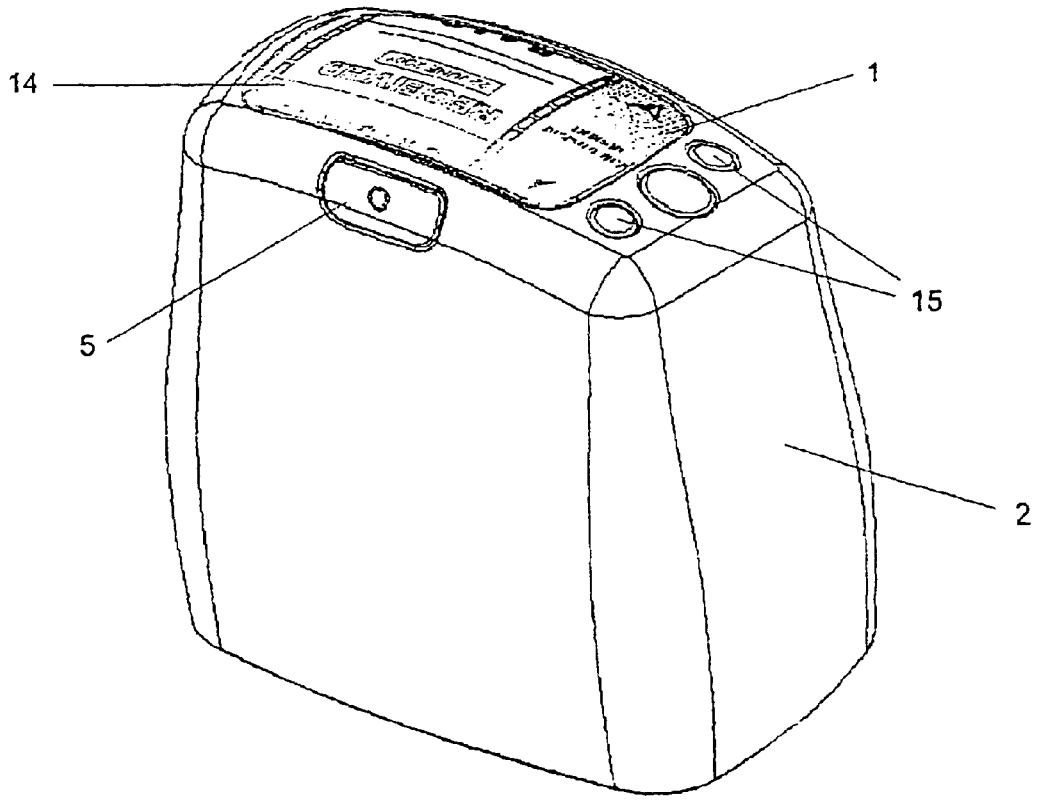

FIG. 6 shows the screen 1 according to the invention built into a simpler form of a printing device 20' intended for printing very short text lines or simpler graphic, that is, the same type of tasks that are today performed by different kinds of stamps and the like.

In this embodiment, the device 20' is first positioned on the printing surface by the same procedure as described above, that is, by showing a preview of a corner of the printout image 7 on the screen, whereupon the device is placed at the desired position on the surface 9, and the printing is effected.

In the embodiment according to FIG. 6, the window 6 may advantageously be used to show a "virtual" strip 14, containing a plurality of predetermined printout alternatives stored on some kind of electronic memory. By means of navigation buttons 15, the user may easily browse to the desired printout alternative.

What is claimed is:

1. A method for operating a handheld printing device having a print head for printing at least one predetermined picture on a printout surface, said method comprising the steps of:

manually steering the entire printing device with the print head over said printout surface with the aid of one or more positioning sensors co-operating with a micro controller circuit to register in real time where the printing device and the print head are located in the printout surface during printing; and showing at each moment on a graphical screen on the device a portion of said picture corresponding in position to the printout in progress, wherein the not finished parts of the printout in progress, at a given moment, are represented as simple contours, which are filled in as the print head passes over these particular parts of the printout.

2. A method as claimed in claim 1, wherein said portion of said picture is shown in a window on said screen, said portion being the portion located underneath the print head and its close vicinity.

3. A method as claimed in claim 1, wherein a preview of an easily recognised part of the complete printout is shown on the screen, and wherein the easily recognised part is used as a reference point for positioning the printout on the printout surface.

4. A method as claimed in claim 1, wherein a portion of said screen shows possible choices among a number of printout alternatives, and wherein a particular printout or a programmable printout can be selected by means of one or more navigation buttons.

5. A method for operating a handheld printing device having a print head for printing at least one predetermined picture on a printout surface, said method comprising the steps of:

manually steering the entire printing device with the print head over said printout surface with the aid of one or more positioning sensors co-operating with a micro controller circuit to register in real time where the printing device and the print head are located in the printout surface during printing;

representing a whole printout page on the screen, and moving over the screen a dynamic rectangle visualizing the print head as the user moves the printing device over said printout page; and showing at each moment on a graphical screen on the device a portion of said picture corresponding in position to the printout in progress.

6. A method for operating a handheld printing device having a print head for printing at least one predetermined picture on a printout surface, said method comprising the steps of:

manually steering the entire printing device with the print head over said printout surface with the aid of one or more positioning sensors co-operating with a micro controller circuit to register in real time where the printing device and the print head are located in the printout surface during printing, wherein a set of graphical arrows are used to indicate to the user where to move the printing device at a given moment; and showing at each moment on a graphical screen on the device a portion of said picture corresponding in position to the printout in progress.

7. A handheld printing device comprising:

a print head for printing at least one predetermined picture on a printout surface;

a graphical screen;

one or more positioning sensors co-operating with a micro controller circuit to register in real time where the printing device and the print head are located in the printout surface during printing, such that, at each moment, a portion of said picture is shown on the screen corresponding in position to the printout in progress; and a set of graphical arrows to indicate to the user where to move the printing device at a given moment.

8. A handheld printing device as claimed in claim 7, further comprising a status field for indicating relevant information, such as how much of the printout that remains, size of paper to be used for the printout or what process is in progress at each moment.

* * * * *